United States Patent [19]

Porter et al.

[11] 4,001,574

[45] Jan. 4, 1977

[54] SUSPENSION FIXTURE

[75] Inventors: David H. Porter; Douglas Bray, both of Fort Atkinson, Wis.

[73] Assignee: Thomas Industries, Inc., Fort Atkinson, Wis.

[22] Filed: Sept. 12, 1975

[21] Appl. No.: 612,904

[52] U.S. Cl. ..... 240/78 E; 240/85 R; 248/327

[51] Int. Cl.[2] ..... F21V 21/00

[58] Field of Search ..... 240/78 E, 81 C, 85 R, 240/78 R, 85 A, 85 B, 85 C, 85 D, 85 E; 248/342, 343, 323, 327, 317

[56] References Cited

UNITED STATES PATENTS

| | | | |
|---|---|---|---|
| 372,940 | 11/1887 | Soden et al. | 240/78 E |
| 1,487,181 | 3/1924 | Robinson | 240/78 E X |
| 1,717,877 | 6/1929 | D'Olier, Jr. | 240/78 E |
| 1,873,385 | 8/1932 | Glowacki | 240/78 E |
| 2,907,545 | 10/1959 | Beck et al. | 240/85 R |
| 3,302,918 | 2/1967 | Cohen | 240/85 R |

*Primary Examiner*—Edna M. O'Connor
*Attorney, Agent, or Firm*—Johnson, Dienner, Emrich & Wagner

[57] ABSTRACT

The present invention provides a suspension lighting fixture utilizing a chain suspension for the lamp holder, and which fixture is attached at its upper end, mechanically and electrically, to an outlet box and to conductors mounted in the ceiling, respectively. The length of the suspension chain is adjustable without requiring cutting or parting of the same. The installation may be expeditiously and cheaply made and the structure involves a minimum of materials. The invention utilizes as an essential element a hanger which is adjustable relative to the individual links of the chain employed and through which hanger the swing canopy may be clamped against the ceiling by cooperating screw threads on said hanger and on the swing canopy.

5 Claims, 14 Drawing Figures

SUSPENSION FIXTURE

BRIEF SUMMARY OF THE INVENTION

The invention involves a suspension lighting fixture utilizing a chain, bearing at its lower end a lamp socket for a lamp and a globe or other lighting elements, and at its upper end a hanger element which is adjustable as to its position along the length of the chain suspension for a higher or lower ceiling. The hanger serves the double function of carrying the weight of the fixture on the mounting strap and has a threaded connection with the swing canopy to bring its upwardly facing rim into contact with the ceiling. The installation of the unit may be performed with a minimum of effort and the installer needs no tools further than a screw driver.

DETAILED DESCRIPTION

Figure 1:
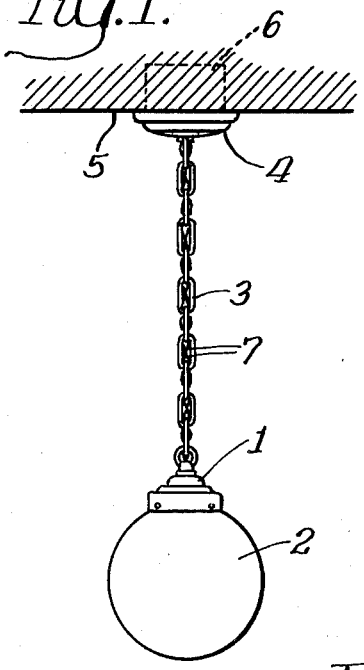
FIG. 1 is a side elevational view of the lighting fixture of our invention in completed form.
Figure 2:
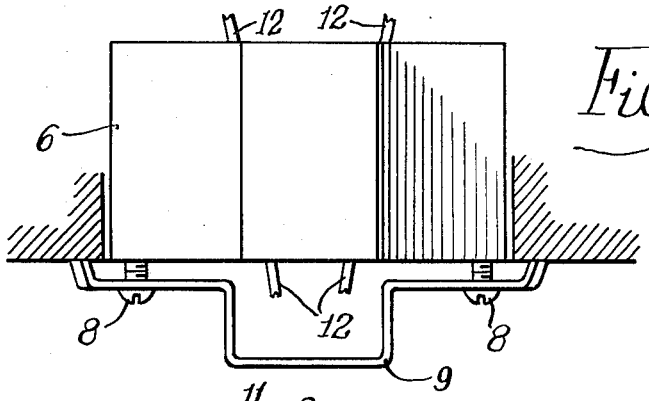
FIG. 2 is a side elevational view showing the ceiling in section and illustrating the mounting strap which is utilized in bringing the rim of the canopy into contact with the ceiling.
Figure 2:
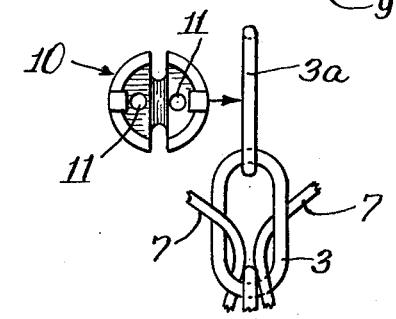

FIG. 1 shows a lamp holder 1 and globe 2 of a lighting fixture suspended by a chain 3 from the swing canopy 4 mounted up against the ceiling 5 under a ceiling outlet box 6 shown in dotted lines. A pair of conductors 7 are interwoven with the links of the chain 3. The outlet box 6 provides threaded sockets for the clamping screws 8, 8 which hold the mounting strap 9 with its ends against the ceiling in proper position for mounting the hanger 10 upon the bracket 9.

Figure 3:
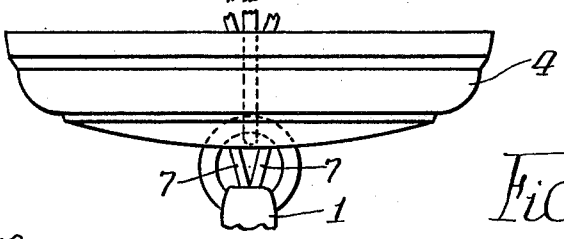
FIG. 3 shows the assembly of the hanger with a link of the chain, in this case the uppermost link.

The hanger 10 is illustrated in top plan view in FIG. 3 in position to be inserted into the uppermost link 3*a*.

The said hanger 10 may be inserted in any link along the length of the chain, the idle part of the chain being merely retained in the swing canopy 4. The chain need not be cut or parted to reduce its effective length. The hanger 10 which has been inserted edgewise into the top link 3*a* of FIG. 3 by hooking it around one side of the top link is then turned sidewise into horizontal position within link 3*a*, as indicated in FIG. 3, and then it is turned to and remains in the position shown in FIGS. 4 and 5, and then the conductors 7, 7 are threaded through the holes 11, 11 as shown in FIGS. 5 to 8.

Figure 5:
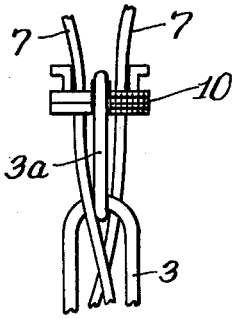
FIG. 5 is a view similar to FIG. 4 showing, however, the threading of the conductors through the holes provided in the hanger.
Figure 6:
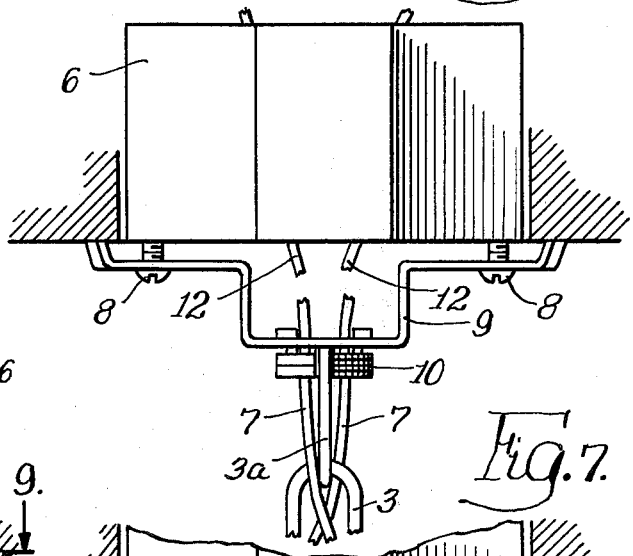
FIG. 6 is a vertical sectional view through the ceiling showing the outlet box and mounting strap with the hanger connected thereto.
Figure 7:
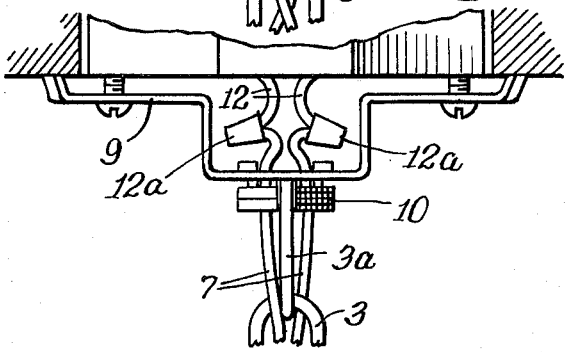
FIG. 7 is a view similar to FIG. 6 showing the connection of the conductors of the fixture to the supply conductors.
Figure 9:
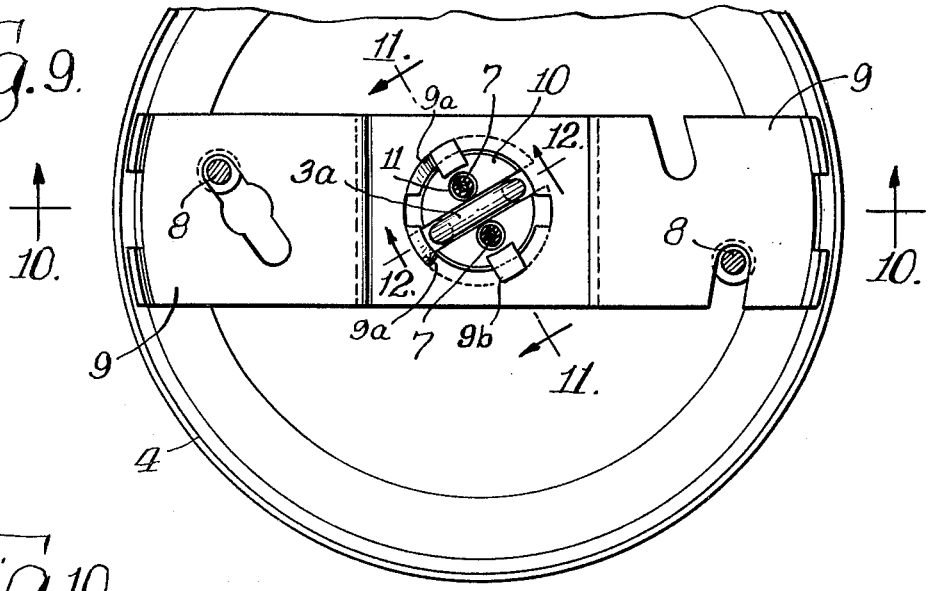
FIG. 9 is a horizontal section in plan view on the line 9—9 of FIG. 8.

The chain link 3*a*, as shown in FIG. 3, having received the hanger 10, as shown in FIG. 5, is taken up the ladder and inserted in the mounting strap 9 as shown in FIG. 6. Thereupon the conductors 7, 7 of the lamp fixture are connected to the supply conductors 12, 12 by insulating connectors 12*a*, 12*a* as shown in FIG. 7. Thereupon the swing canopy 4 (see FIG. 3) which has been slipped down over the links of the chain 3 before the insertion of the hanger 10 in the top link is now brought up from the position shown in FIG. 3 to the position shown in FIG. 8 by threading the said swing canopy 4 over the threads of the hanger 10 as shown in FIG. 8.

If a shorter length of chain is desired, this is readily accomplished without cutting or parting the chain, by inserting the hanger 10 into a link 3 at the desired height, and allowing the excess links to remain suspended from the uppermost active link or to be removed after the fixture has otherwise been prepared to be installed. Alternatively, the upper idle links may be disposed within the vacant space in the canopy 4. This is possible since the vertical position of the top active link has ample idle length between its vertical limbs to allow the top active link to keep the first idle link between it and the hanger 10 with the other surplus links carried in the otherwise empty space in the canopy. Since all of the links are of the same dimensions, the hanger 10 will cooperate with the upper end of any link selected. The hanger 10 may be inserted in the upper end of any one of these links by moving the immediately superior link downwardly out of the way and inserting the hanger 10 in the top of the uppermost link as shown in FIG. 3.

Figure 4:
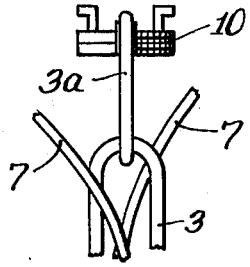
FIG. 4 shows the completed assembly of the hanger and upper length of the chain after the hook of the hanger has been inserted into the link of the chain.
Figure 8:
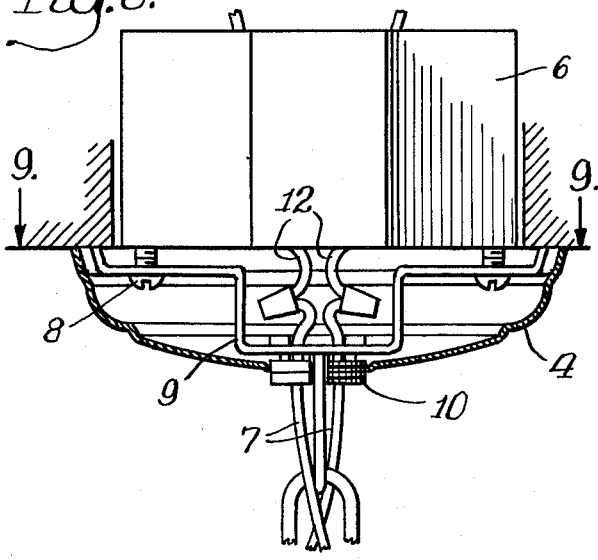
FIG. 8 is a vertical axial section of the canopy and the outlet box with the other parts of the complete assembly in side elevation.

With the hanger 10 inserted in the uppermost link in the horizontal position shown in FIGS. 4 and 5, and the conductors 7 having been inserted through the openings 13 and the connectors 12*a*, 12*a* have been applied to the meeting ends of the supply terminals and the lamp terminals, as shown in FIGS. 7 and 8, the swing canopy is raised into contact with the lower end of the hanger 10 and threaded upon said hanger 10 as shown in FIG. 8.

Figure 10:
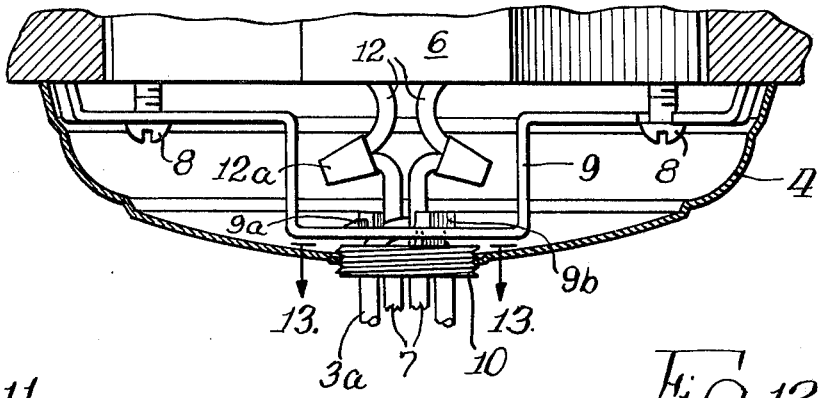
FIG. 10 is a vertical section taken on the line 10—10 of FIG. 9.
Figure 11:
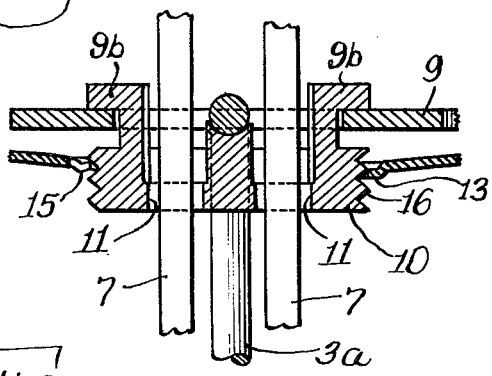
FIG. 11 is a vertical section taken on the line 11—11 of FIG. 10.
Figure 12:
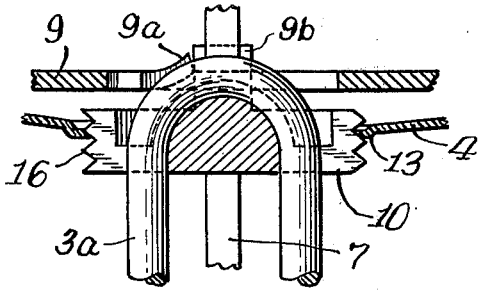
FIG. 12 is a vertical section taken on the line 12—12 of FIG. 9.
Figure 13:
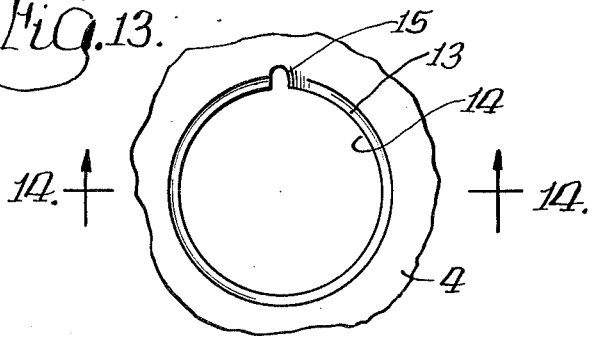
FIG. 13 is a plan view of the threaded opening through the swing canopy showing the lips of the thread formed on the edge of the opening through which the hanger threads.
Figure 14:
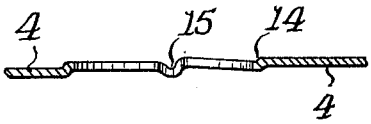
FIG. 14 is an edge view of the said thread formation taken on line 14—14 of FIG. 13.

This threading of the canopy 4 upon the hanger 10 is possible by a provision of the shape of the margin 13 of the hole 14 shown in FIGS. 13 and 14. Also, this is illustrated in FIGS. 10, 11 and 12. The edge of the opening of the swing canopy 4 is notched as shown at 15 in FIG. 14. By preforming the edge of the hole in the canopy into helical form, or approximately so, the canopy may be threaded onto the hanger 10 as shown in FIGS. 11 and 12. The installation is thus completed. Due to the fact that the mounting strap 9 is mounted against the surface of the ceiling and not to the surface of the outlet box, the canopy 4 being threaded on the screw threads 15 of the hanger 10 fits tightly against the ceiling.

In the commercial embodiment of the invention, the diameter of the threaded hole 14 in the canopy 4 is one inch. In case of loss of the lockup part namely the hanger 10, the threaded hole in the canopy 4 allows the canopy to be used with conventional type mounting hardware.

The invention claimed is:

1. For use with a ceiling outlet box having side walls and an open bottom and having diametrically disposed screw sockets on the inside of opposite side walls, a mounting strap having a downwardly extending laterally offset central portion including notches and integral lateral horizontal wings, said wings having mounting slots adapted to register with said screw sockets, screws cooperating with said slots in the wings and adapted to cooperate with the said screw sockets of the box for releasably mounting said strap on the open side of said box, said strap having upwardly extending end portions adapted to engage the ceiling outside the box, a suspension chain carrying a suspension fixture on the lower end of the chain and having a top oblong terminal link, a hanger, said chain being attached to the hanger at its upper end, said hanger having a restricted central portion embraced by the uppermost link of the suspension chain, and said hanger having one or more axially extending openings for conductor wires, conductor wires extending through said openings and extending along links of the chain to the suspended fixture, a canopy having a central screw-threaded hole, said hanger being externally screw-threaded to engage the internal screw threads of the said canopy, and the hanger having at its upper end outwardly extending lugs adapted to be passed through the mounting strap and turned on its longitudinal axis to anchor it to said strap, the hanger having at its upper end wings which may be extended through said notches in the mounting strap and rotated out of register with said notches to hold the fixture in suspension.

2. The combination of claim 1 wherein the hanger is a unitary body having two longitudinally extending oppositely disposed grooves for receiving the opposite sides of the said oblong terminal link (3) of the suspending chain.

3. The combination of claim 1 wherein the mounting strap (9) has laterally offset wings at its ends, said wings being adapted to extend beyond the edges of the ceiling box (6) to support the canopy (4) flush with the ceiling.

4. The combination of claim 1 wherein the canopy (4) is constructed of sheet metal and has the edge of the central hole notched (15) and the edges adjacent said notch offset to match the threads (16) of the hanger (10) whereby the canopy (4) may be screwed upwardly on the hanger (10) to make contact of its outer edge with the adjacent ceiling surface.

5. The combination of claim 1 wherein the hanger (10) is capable of being mounted in a link (**3*a*) of the chain intermediate the length of the chain and the upper part of the chain is capable of being disposed in said canopy (4**).

* * * * *